US006257213B1

(12) United States Patent
Maeda

(10) Patent No.: US 6,257,213 B1
(45) Date of Patent: Jul. 10, 2001

(54) EXHAUST GAS RECIRCULATION DEVICE

(76) Inventor: Yoshihide Maeda, c/o Hino Jidosha Kogyo Kabushiki Kaisha, 1-1, Hinodai 3-chome, Hino-shi, Tokyo 191-8660 (JP)

( * ) Notice: Subject to any disclaimer, the term of this patent is extended or adjusted under 35 U.S.C. 154(b) by 0 days.

(21) Appl. No.: 09/355,358

(22) PCT Filed: Jan. 9, 1998

(86) PCT No.: PCT/JP98/00050

§ 371 Date: Jul. 28, 1999

§ 102(e) Date: Jul. 28, 1999

(87) PCT Pub. No.: WO98/32961

PCT Pub. Date: Jul. 30, 1998

(30) Foreign Application Priority Data

Jan. 29, 1997 (JP) ..... 9-015399

(51) Int. Cl.[7] ..... F02D 13/04; F01L 13/06; F02M 25/07

(52) U.S. Cl. ..... 123/568.14; 123/321

(58) Field of Search ..... 123/568.14, 321

(56) References Cited

U.S. PATENT DOCUMENTS 5,406,918 * 4/1995 Joko et al. ..... 123/568.14
5,546,914 * 8/1996 Scheinert ..... 123/568.14

* cited by examiner

*Primary Examiner*—Tony M. Argenbright
*Assistant Examiner*—Arnold Castro

(57) ABSTRACT

The present invention is directed to an exhaust gas recirculation apparatus in which an exhaust-gas-recirculation master piston (12) is actuated by a suction rocker arm (10) to drive a slave piston (14) which in turn opens an exhaust valve (4) on the same cylinder (1) during a suction stroke. As a result, owing to pressure difference, the exhaust gas is recirculated from an exhaust port (5) into a combustion chamber (2) to lower the combustion temperature in the combustion chamber (2) during a next power stroke and to promote decrease of $NO_x$.

2 Claims, 4 Drawing Sheets

EXHAUST GAS RECIRCULATION DEVICE

TECHNICAL FIELD

This invention relates to an exhaust gas recirculation apparatus (EGR apparatus) in which a portion of exhaust gas is recirculated together with sucked air into a combustion chamber so as to lower combustion temperature in the combustion chamber, thereby promoting decrease of $NO_x$ (nitrogen oxides).

BACKGROUND ART

In a conventional exhaust gas recirculation apparatus, an exhaust pipe is communicated with a suction port via external piping. A normally closed EGR valve arranged intermediately of the external piping is opened during a suction stroke by utilization of negative pressure in the suction port to thereby recirculate the exhaust gas through the external piping.

However, the above-mentioned conventional exhaust gas recirculation apparatus provides lean combustion during the suction stroke since the exhaust gas is always sucked into the combustion chamber during the suction stroke. Though satisfactory combustion may be attained in light-load operating ranges where the air is inherently excessive, unsatisfactory combustion may be disadvantageously brought about in high-load operating ranges where the ratio of air to fuel is lower, which tends to produce sooty black smoke.

Furthermore, disadvantageously, a required installation space for the engine is increased because of the external piping with the EGR valve required. Consideration must be taken to thermal insulation and arrangement constraints of the external piping which will reach high temperatures due to the exhaust gas flowing through the external piping.

Moreover, there is a problem for example in an engine with a turbocharger that exhaust gas cannot be satisfactorily recirculated in operating ranges where the boost pressure (supercharging pressure in a suction pipe) is higher than the exhaust pressure.

The present invention was made in view of the above facts and has its object to provide an exhaust gas recirculation apparatus in which exhaust gas can be recirculated only in operating ranges where it is required, in which the exhaust gas can be recirculated without use of external piping and in which the exhaust gas can be satisfactorily recirculated even in operating ranges where the boost pressure is higher than the exhaust pressure for example in a case of an engine with a turbocharger.

DISCLOSURE OF THE INVENTION

The present invention is directed to an exhaust gas recirculation apparatus characterized in that it comprises an exhaust-gas-recirculation master piston actuated by a suction rocker arm which in turns opens a suction valve on a cylinder during the suction stroke, a slave piston connected via an oil passage to said master piston for opening an exhaust valve on the same cylinder having said suction valve when said oil passage is pressurized by the actuation of said master piston and operating oil supply means for switching maintaining and releasing of oil pressure in said oil passage.

Thus, when oil pressure in the oil passage is maintained by the operating oil supply means, the master piston is actuated by the suction rocker arm during the suction stroke; the oil passage is pressurized; and the slave piston is driven to open the exhaust valve on the same cylinder. As a result, owing to pressure difference, the exhaust gas is recirculated from the exhaust port into the combustion chamber so that the combustion temperature in the combustion chamber is lowered during a next power stroke, thereby promoting decrease of $NO_x$.

When oil pressure in the oil passage is released by the operating oil supply means, no oil passage is pressurized and therefore no slave piston is driven. As a result, opening of the exhaust valve is effected only during the exhaust stroke due to normal valve operation, not during the suction stroke.

The invention is also directed to an exhaust gas recirculation apparatus characterized in that it comprises an exhaust-gas-recirculation master piston actuated by an exhaust rocker arm which in turns opens an exhaust valve on a cylinder during the exhaust stroke, a slave piston connected via an oil passage to said master piston for opening a suction valve on the same cylinder having said exhaust valve when said oil passage is pressurized by the actuation of said master piston and operating oil supply means for switching maintaining and releasing of oil pressure in said oil passage.

Thus, when oil pressure in the oil passage is maintained by the operating oil supply means, the master piston is actuated by the exhaust rocker arm during the exhaust stroke; the oil passage is pressurized; and the slave piston is driven to open the suction valve on the same cylinder. As a result, a portion of the exhaust gas in the combustion chamber is discharged to the suction port side. The exhaust gas thus discharged to the suction port side is sucked back and recirculated into the combustion chamber during a next suction stroke to lower the combustion temperature in the combustion chamber during a next power stroke, thereby promoting decrease of $NO_x$.

When oil pressure in the oil passage is released by the operating oil supply means, no oil passage is pressurized and therefore no slave piston is driven. As a result, the suction valve is opened only during the suction stroke due to normal valve operation, not during the exhaust stroke.

BEST MODES FOR CARRYING OUT THE INVENTION

Embodiments of the invention will be described in conjunction with the drawings.

Figure 1:
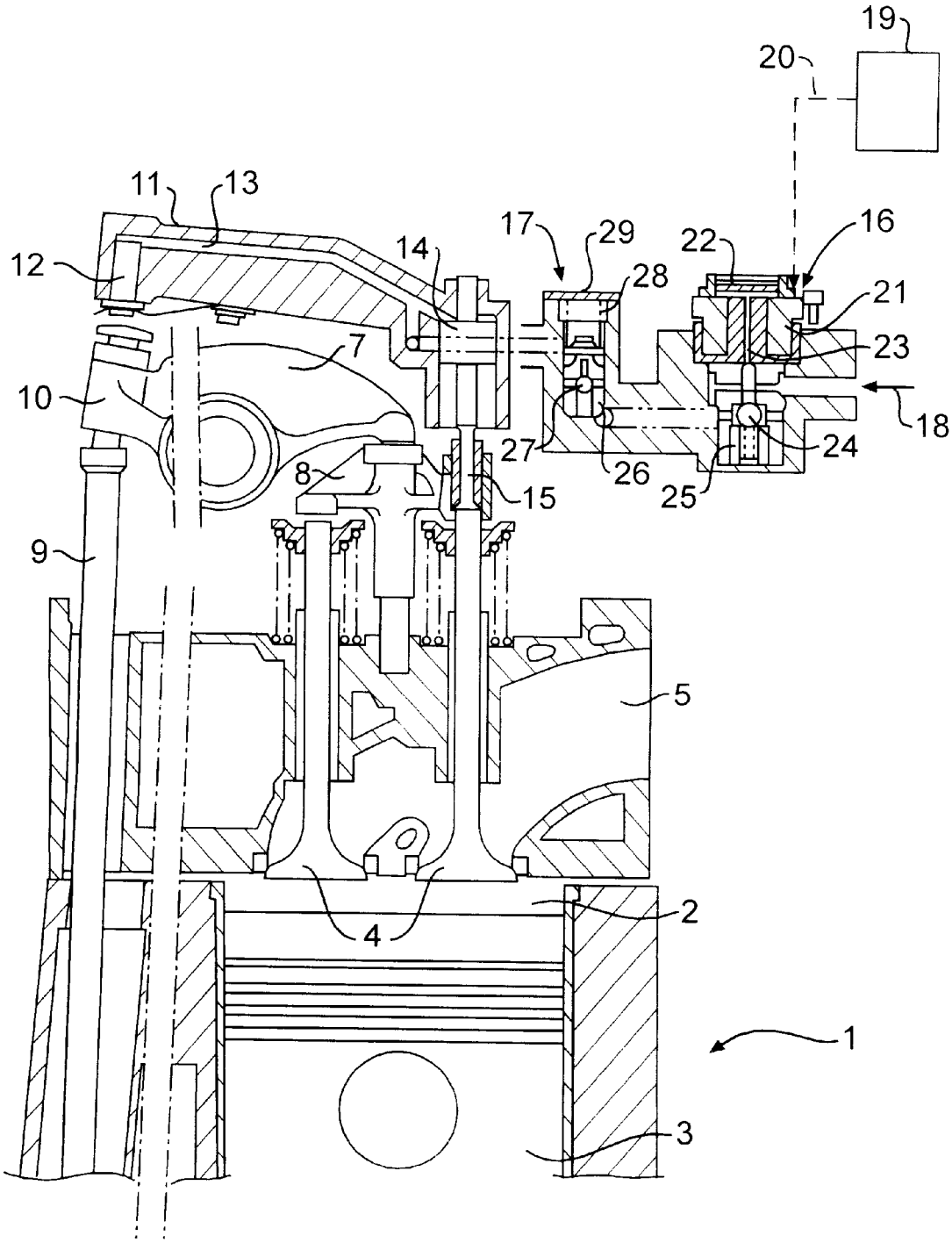
FIG. 1 is a sectional view showing an embodiment of the invention.
Figure 2:
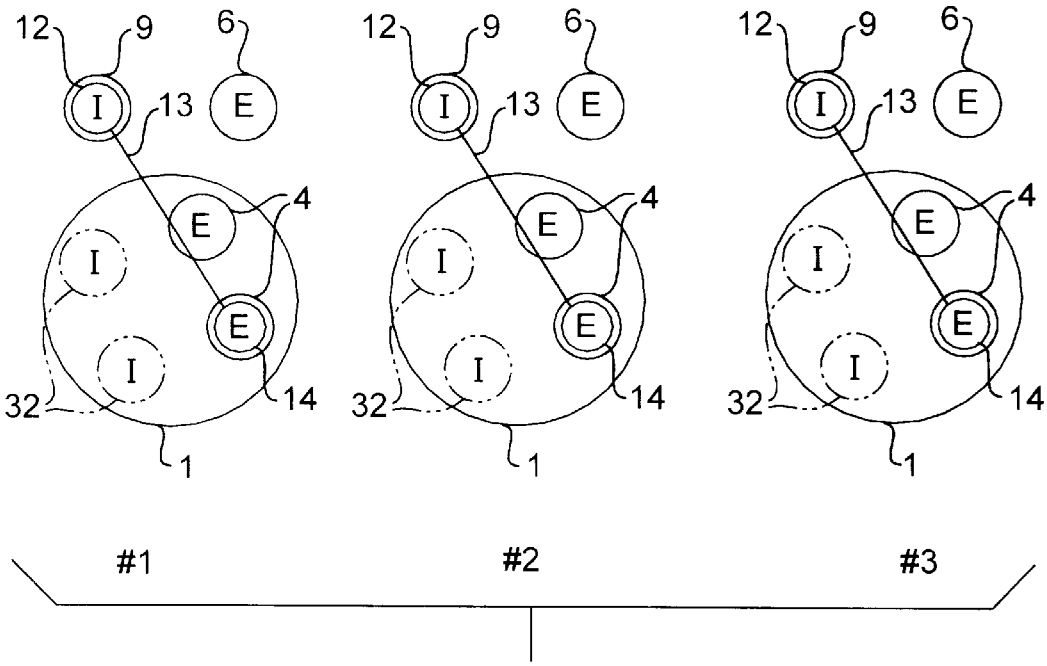
FIG. 2 is an explanatory diagram showing an arrangement of a plurality of cylinders.
Figure 3:
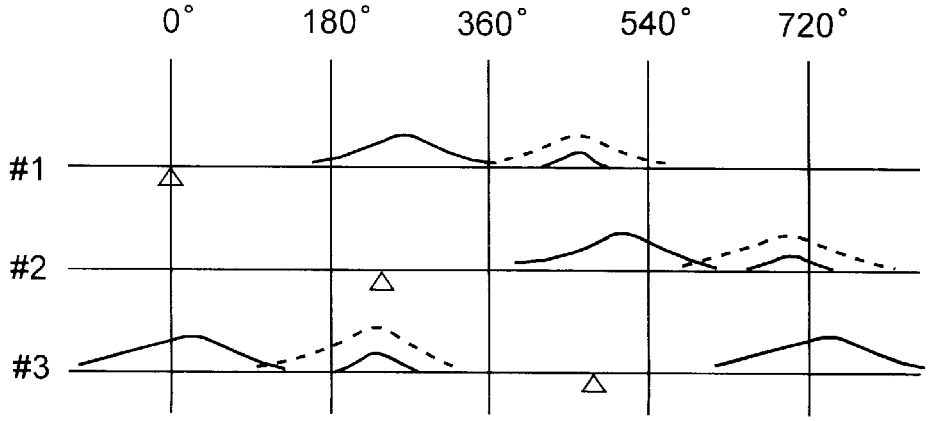
FIG. 3 is a graph showing operational timings of exhaust valves in the respective cylinders shown in FIG. 2.

FIGS. 1 to 3 show an embodiment of the invention. In FIG. 1, reference numeral 1 denotes a cylinder; 2, a combustion chamber; 3, a piston; 4, exhaust valves; and 5, an exhaust port. During an exhaust stroke, an exhaust push rod 6 (see FIG. 2) pushes up one end of an exhaust rocker arm 7 to pivotally move the rocker arm 7 so that both the exhaust valves 4 are pushed down and opened by the other end of the rocker arm 7 through an abutment 8. As a result, the exhaust gas is discharged from the combustion chamber 2 to the exhaust port 5.

Reference numeral 9 designates an inlet push rod for the same cylinder 1 shown; and 10, a suction rocker arm which is pushed up at its one end and is pivotally moved by the inlet push rod 9 during a suction stroke. Both suction valves 32 (see FIG. 2) are pushed down and opened by the other end of the suction rocker arm 10 through an abutment (not shown) which is similar to that mentioned above. In this case, the one end of the suction rocker arm 10 pushes up an exhaust-gas-recirculation master piston 12 arranged in an upper housing 11 to pressurize an oil passage 13 drilled in the housing 11 so that a slave piston 14 is pushed down to independently push down one of the exhaust valves 4 through an actuator pin 15.

Operating oil 18 (engine oil) is supplied to the oil passage 13, which connects the master piston 12 with the slave piston 14, via operating oil supply means for switching maintaining and releasing of oil pressure of the oil passage 13 which comprises a solenoid valve 16 and a control valve 17. The solenoid valve 16 serves to supply/cut off the operating oil 18 by a control signal 20 from a controller 19. The control valve 17 serves as a check valve for maintaining the oil pressure in the oil passage 13 when the solenoid valve 16 is open, and serves to release the oil pressure of the oil passage 13 when the solenoid valve 16 is closed.

More specifically, in the solenoid valve 16, exciting of a coil 21 causes a plate 22 and an iron core 23 to push a ball 24 down to effect supply of the operating oil 18. When the coil 21 is not excited, the ball 24 is pushed up by a spring 25 to cut off the supply of the operating oil 18. In the control valve 17, a spool 26 is pushed up by the oil pressure to allow the operating oil 18 to flow only in a direction toward the oil passage 13 when the solenoid valve 16 is open. The spool 26 is pushed down by a spring 28 to release the oil pressure to a relief port 29 when the solenoid valve 16 is closed.

FIG. 2 shows an arrangement of this embodiment in a case of an in-line six-cylinder engine in which only a first cylinder #1 (1), a second cylinder #2 (1) and a third cylinder #3 (1) are shown. In any of these first through third cylinders 1, one of the exhaust valves 4 on the cylinder 1 is opened by the inlet push rod 9 on the same cylinder 1 during the suction stroke. More specifically, the master piston 12 is actuated via the suction rocker arm 10 (not shown in FIG. 2) by the inlet push rod 9 on each cylinder 1 to drive the slave piston 14 on the same cylinder 1 through the oil passage 13 to thereby open one of the exhaust valves 14 during the suction stroke.

Thus, whenever the solenoid valve 16 is opened by the control signal 20 from the controller 19, the control valve 17 serves as the check valve to close the oil passage 13. As a result, during any of the suction strokes of the first cylinder #1 (1), the second cylinder #2 (1) and the third cylinder #3 (1) shown in FIG. 2 with different timings as shown in FIG. 3, upward pushing movement of the inlet push rod 9 for opening of the suction valves 32 pivotally moves the suction rocker arm 10 so that the master piston 12 is pushed up to pressurize the oil passage 13 and drive the slave piston 14 on the same cylinder 1 to open one of the exhaust valves 14. As a result, owing to pressure difference, the exhaust gas is recirculated from the exhaust port 5 into the combustion chamber 2 to lower the combustion temperature in the combustion chamber 2 during a next power stroke, thus promoting decrease of $NO_x$, (nitrogen oxides).

It is to be noted that, in FIG. 3, ordinates represent lifts (lift heights) in the valve operations and abscissas, rotation angles of the camshaft of the first cylinder #1. In the diagram, Δs indicate compression top dead centers of the respective cylinders 1; solid curve lines, the lifts of the exhaust valves 4 in the respective cylinders 1; and broken curve lines, the lifts of the suction valves 32 in the respective cylinders 1. (For example, in the first cylinder #1, the range of camshaft rotation angles from 0° to 180° corresponds to a power stroke; 180° to 360°, an exhaust stroke; 360° to 540°, a suction stroke; and 540° to 720°, a compression stroke: the phases of the second and third cylinders #2 and #3 are shifted with their compression top dead centers being starting points.)

Whenever the solenoid valve 16 is closed by the control signal 20 from the controller 19, the oil pressure in the oil passage 13 is released by the control valve 17 and therefore no oil passage 13 is pressurized. As a result, no slave piston 14 is driven and the exhaust valve 4 is opened only during the exhaust stroke due to normal valve operation, not during the suction stroke.

Consequently, according to the above-mentioned embodiment, the exhaust gas can be recirculated to the combustion chamber 2 only in operating ranges where it is required. In light-load operating ranges, the exhaust gas can be recirculated to the combustion chamber 2 to lower the combustion temperature to thereby prompt decrease of $NO_x$, while in high-load operating ranges, the recirculation of the exhaust gas is ceased to prevent generation of sooty black due to normal valve operation.

Moreover, the fact that no external piping is required avoids increase in volume of the installation space for the engine and eliminates the necessity of consideration on heat insulation and arrangement constraints of the external piping. Furthermore, in the case of for example an engine with a turbocharger, exhaust gas can be satisfactorily recirculated even in operating ranges where boost pressure is higher than exhaust pressure.

In order to make control such that the exhaust gas is recirculated to the combustion chamber 2 in light-load operating ranges and the recirculation of the exhaust gas is ceased in high-load operating ranges, it may suffice that a signal representing the engine operating status, a signal representing the accelerator operating status, a signal for exhaust gas recirculation switch of the operating chamber and the like are inputted to the controller 19 and that the solenoid valve 16 is opened by the control signal 20 from the controller 19 when the exhaust gas recirculation switch of the operating chamber is ON and the engine is in output operation with the accelerator being pushed down to some extent and with no high load.

Figure 4:
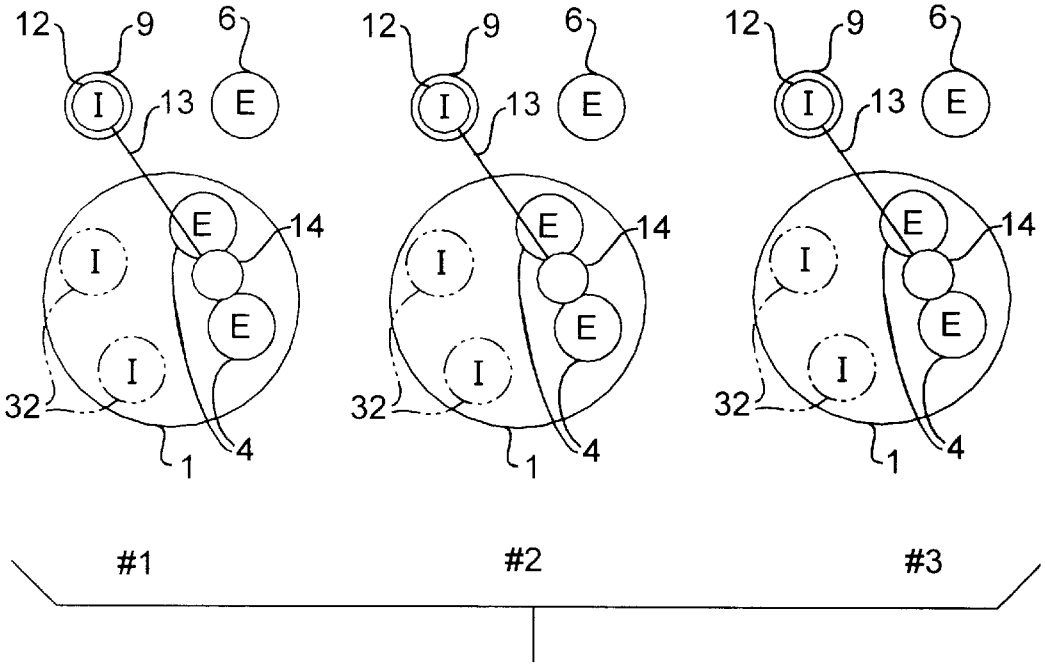
FIG. 4 is an explanatory diagram showing a second embodiment of the invention.
Figure 5:
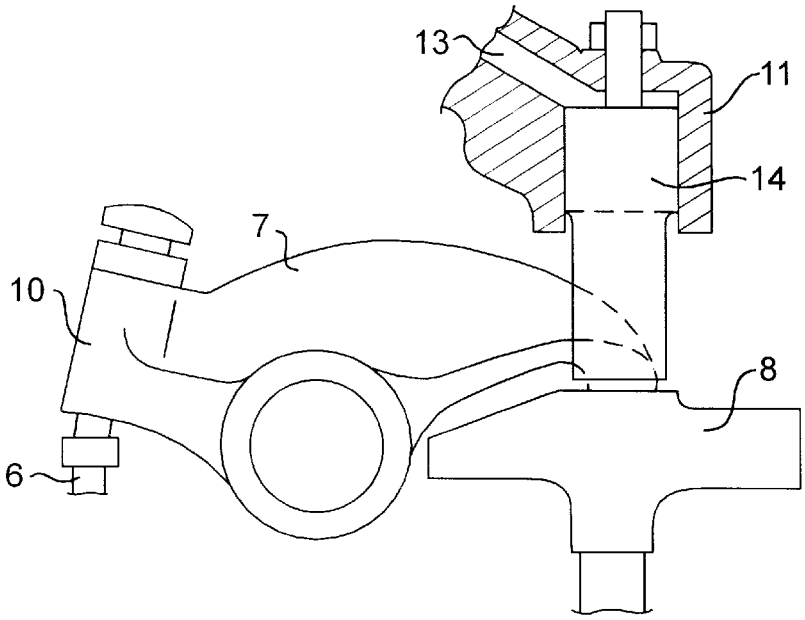
FIG. 5 is a detailed view of an example of a slave piston used in the second embodiment.

FIGS. 4 and 5 show a second embodiment of the invention in which both the exhaust valves 4 of each cylinder 1 are opened together by the slave piston 4 during the suction stroke. In this embodiment, the slave piston 14 is such that, during the suction stroke, it can push down the abutment 8 which is pushed down by the exhaust rocker arm 7 due to normal valve operation during the exhaust stroke; the slave piston is placed over the exhaust rocker arm 7 so that it will not interfere with the normal valve operation during the exhaust stroke (see FIG. 5).

This enables both the exhaust valves 4 to be opened together during the suction stroke so that recirculation efficiency of the exhaust gas can be enhanced. Opening both the exhaust valves 4 can be effected without significant difficulty since the pressure in the combustion chamber 2 is lowered during the suction stroke.

Figure 6:
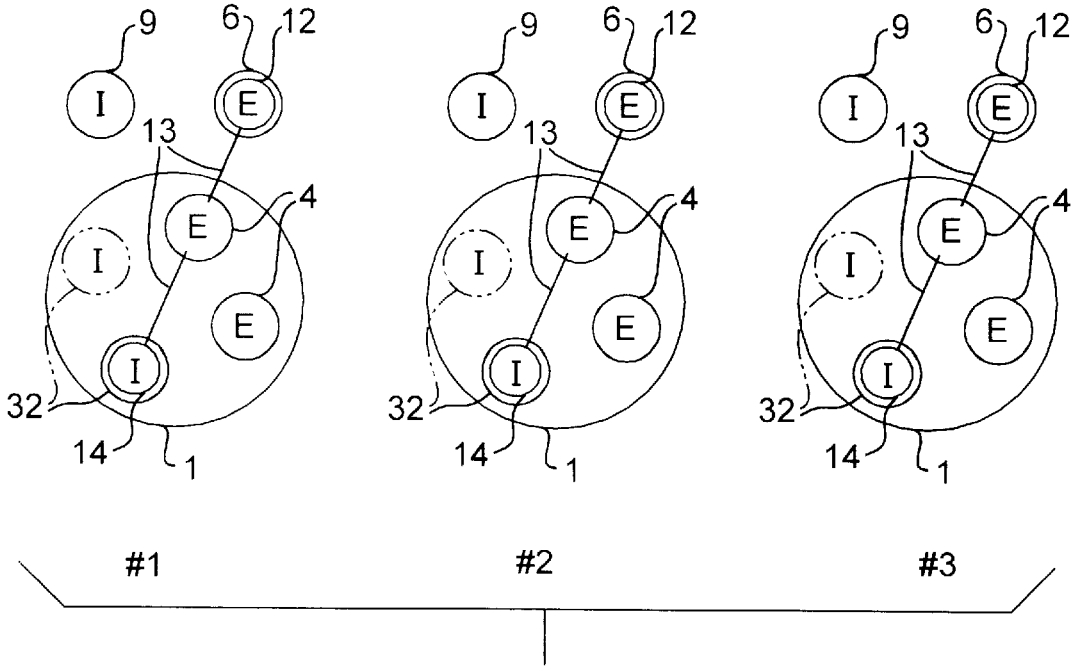
FIG. 6 is an explanatory diagram showing a third embodiment of the invention.
Figure 7:
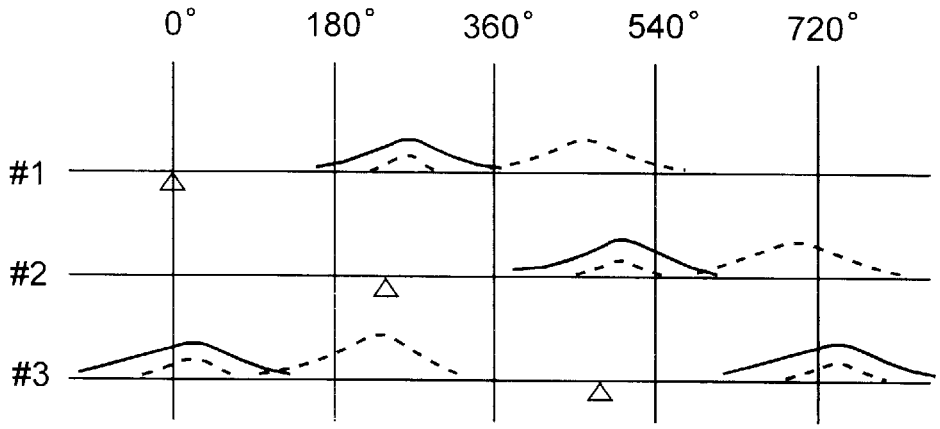
FIG. 7 is a graph showing operational timings of exhaust valves in the respective cylinders shown in FIG. 6.

FIGS. 6 and 7 show a third embodiment of the invention in which the master piston 12 is actuated by the exhaust rocker arm 7 which in turn opens the exhaust valves 4 on the cylinder 1 during the exhaust stroke; this actuation of the master piston 12 can cause one of suction valves 32 on the same cylinder 1 to be opened by the slave piston 14 during the exhaust stroke.

More specifically, as exemplified in FIG. 7 with reference to only the cylinder #1 (1), the cylinder #2 (1) and the cylinder #3 (1) of an in-line six-cylinder engine, in any of the first through third cylinders 1, one of the suction valves 32 on the cylinder 1 is opened during the exhaust stroke by the exhaust push rod 6 on the same cylinder 1. Further specifically, one of the exhaust valves 4 can be opened during the suction stroke by the slave piston 14 on the same cylinder 1 which in turn is driven via the oil passage 13 by the master piston 12 which in turn is actuated via the exhaust rocker arm 7 (not shown in FIG. 6) by the exhaust push rod 6 on the cylinder 1.

Here, the slave piston 14 which opens the suction valve 32 during the exhaust stroke may be such that it has a structure similar to the slave piston 14 shown in FIG. 1. Alternatively, the slave piston similar to that shown in FIG. 5 may be employed so as to open both the exhaust valves 32 together during the exhaust stroke.

Of course, the oil passage 13 in this embodiment also has operating oil supply means for switching maintaining and releasing of the oil pressure in the oil passage 13, which may comprises those similar to the above-mentioned solenoid valve 16 and control valve 17.

In this way, during any of the exhaust strokes of the first cylinder #1 (1), the second cylinder #2 (1) and the third cylinder #3 (1) shown in FIG. 6 with different timings as shown in FIG. 7, upward pushing movement of the exhaust push rod 9 for opening of the exhaust valves 4 pivotally moves the exhaust rocker arm 7 so that the master piston 12 is pushed up to pressurize the oil passage 13 and drive the slave piston 14 on the same cylinder 1 to open one of the suction valves 32. As a result, a portion of the exhaust gas in the combustion chamber 2 is discharged to the suction port side (not shown). The exhaust gas thus discharged to the suction port side is sucked back and recirculated into the combustion chamber 2 during a next suction stroke to lower the combustion temperature in the combustion chamber 2 during a next power stroke, thereby promoting decrease of $NO_x$ (nitrogen oxides).

In FIG. 7, as in the case of FIG. 3 referred to the above, ordinates represent lifts (lift heights) in the valve operations and abscissas, rotation angles of the camshaft of the first cylinder #1. In the diagram, Δs indicate compression top dead centers of the respective cylinders 1; solid curve lines, the lifts of the exhaust valves 4 in the respective cylinders 1; and broken curve lines, the lifts of the suction valves 32 in the respective cylinders 1.

Consequently, also in this embodiment, the exhaust gas can be recirculated to the combustion chamber 2 only in operating ranges where it is required. In light-load operating ranges, the exhaust gas can be recirculated to the combustion chamber 2 to lower the combustion temperature to thereby prompt decrease of $NO_x$, while in high-load operating ranges, the recirculation of the exhaust gas is ceased to prevent generation of sooty black due to normal valve operation. Moreover, the fact that no external piping is required avoids increase in volume of the installation space for the engine and eliminates the necessity of consideration on heat insulation and arrangement constraints of the external piping. Furthermore, in the case of for example an engine with a turbocharger, exhaust gas can be satisfactorily recirculated even in operating ranges where boost pressure is higher than exhaust pressure.

It is also to be noted that the exhaust gas recirculation apparatus of the invention is not limited to the embodiments described above and that various variations and modifications may be made without departing from the gist of the invention. For example, in-line six-cylinder engines have been described in the above embodiments; however, the invention may be applicable in a similar manner to other types of engines such as V-engines with different number of cylinders.

INDUSTRIAL APPLICABILITY

As is clear from the above, the exhaust gas recirculation apparatus according to the invention will find utility as means for purging exhaust gas of engines in automobiles and the like and is particularly applicable for use, for example, in an engine with smaller installation space and in an engine with a turbocharger.

What is claimed is:

1. An exhaust gas recirculation apparatus characterized in that it comprises an exhaust-gas-recirculation master piston actuated by a suction rocker arm which in turn opens a suction valve on a cylinder during the suction stroke, a slave piston connected via an oil passage to said master piston for opening an exhaust valve on the same cylinder having said suction valve when said oil passage is pressurized by the actuation of said master piston, an operating oil means for supplying, switching, maintaining and releasing oil pressure in said oil passage, and a unitary passage connecting said operating oil means to said oil passage.

2. An exhaust gas recirculation apparatus as claimed in claim 1 characterized in that it is applied to an in-line six-cylinder engine.

* * * * *